US006904661B2

(12) United States Patent
Zolnier et al.

(10) Patent No.: US 6,904,661 B2
(45) Date of Patent: Jun. 14, 2005

(54) METHOD OF FABRICATING SURFACE COATED SPHERICAL SLIP JOINT FOR FORMING A SEALED INTERFACE

(75) Inventors: S. Scott Zolnier, Scottsville, NY (US); Charles E. Aldridge, Scottsville, NY (US); Clifford W. Rabidoux, Rochester, NY (US)

(73) Assignee: Heany Industries, Inc., Scottsville, NY (US)

( * ) Notice: Subject to any disclaimer, the term of this patent is extended or adjusted under 35 U.S.C. 154(b) by 0 days.

(21) Appl. No.: 10/634,933

(22) Filed: Aug. 5, 2003

(65) Prior Publication Data

US 2005/0029808 A1 Feb. 10, 2005

(51) Int. Cl.[7] ..... B23P 25/00; C23C 4/08

(52) U.S. Cl. ..... 29/458; 427/456

(58) Field of Search ..... 29/458, 888.061, 29/888.074, 890.08, 428, 527.1, 527.2; 427/456, 455, 453, 446

(56) References Cited

U.S. PATENT DOCUMENTS

| | | | | |
|---|---|---|---|---|
| 2,775,531 A | | 12/1956 | Montgomery et al. | |
| 3,254,970 A | | 6/1966 | Dittrich et al. | |
| 3,279,939 A | | 10/1966 | Yenni | |
| 3,607,343 A | | 9/1971 | Longo et al. | |
| 3,640,755 A | * | 2/1972 | Barth | 427/456 |
| 3,844,729 A | | 10/1974 | Sedlatschek et al. | |
| 4,723,518 A | * | 2/1988 | Kawasaki et al. | 123/188.8 |
| 5,271,967 A | * | 12/1993 | Kramer et al. | 427/455 |
| 5,338,577 A | | 8/1994 | Burdette, II | |
| 5,466,906 A | * | 11/1995 | McCune et al. | 219/121.47 |
| 5,683,119 A | | 11/1997 | Emmons et al. | |
| 6,017,591 A | | 1/2000 | Popoola et al. | |
| 6,129,994 A | | 10/2000 | Harada et al. | |
| 6,245,390 B1 | | 6/2001 | Baranovski et al. | |
| 6,376,091 B1 | | 4/2002 | Croopnick | |
| 6,416,877 B1 | | 7/2002 | Perrin et al. | |
| 6,475,647 B1 | | 11/2002 | Mendez Acevedo et al. | |
| 6,482,476 B1 | | 11/2002 | Liu | |
| 6,497,758 B1 | | 12/2002 | Hasz et al. | |

FOREIGN PATENT DOCUMENTS

| | | |
|---|---|---|
| JP | 4358055 | 12/1992 |
| JP | 5033113 | 2/1993 |

OTHER PUBLICATIONS

English Abstract of Japanese Patent 4358055.
English Abstract of Japanese Patent 5033113.

* cited by examiner

*Primary Examiner*—John C. Hong
(74) *Attorney, Agent, or Firm*—Brian B. Shaw, Esq.; Stephen B. Salai, Esq.; Harter Secrest & Emery LLP

(57) ABSTRACT

A surface coating for forming a sealed interface is formed on a substrate, without requiring subsequent finishing operations. The sealed confronting surfaces employ the same coating and can accommodate vibratory movement and high temperature corrosion. A mixture of metal powder and a non reactive ceramic grit are impacted on a substrate at a sufficient velocity to form a lenticular layer and at a sufficiently low temperature to preclude morphology change in the non reactive grit and chemistry of the metal powder.

10 Claims, 2 Drawing Sheets

FIGURE 1
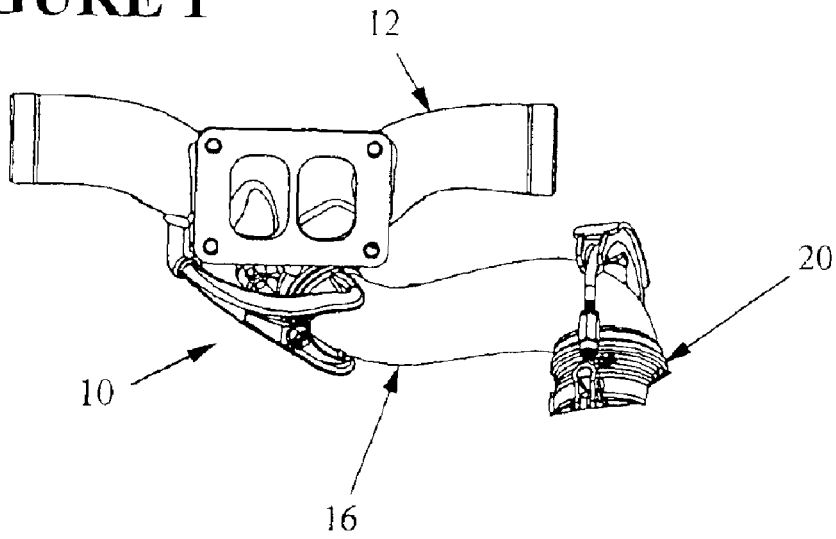
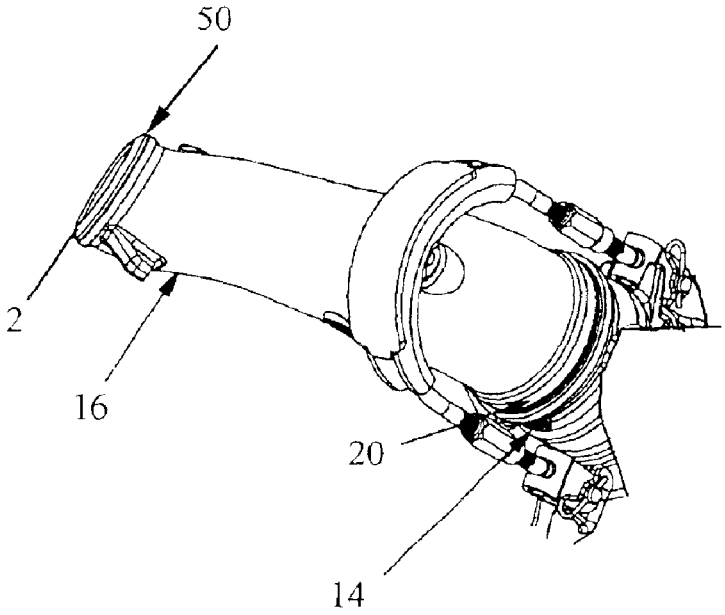
FIGURE 2

METHOD OF FABRICATING SURFACE COATED SPHERICAL SLIP JOINT FOR FORMING A SEALED INTERFACE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to surface coatings, and more particularly, to a surface coating for forming a sealed interface between confronting surfaces such as spherical slip joints, as well as a method for forming the surface coating.

2. Description of Related Art

Coating metal components with a thin layer of ceramic material or another metal has been practiced for many years. Typically, the coating process impacts a metal powder or ceramic powder to deposit the material onto the substrate. The coating process typically uses thermal equipment which results in a chemical reaction and morphology change of the sprayed particulate constituents to produce a resulting coating of a different chemical composition on the impacted substrate.

However, these processes and constituent materials typically result in an expensive coating. Further, the coatings require relatively stable environments. That is, the resulting coatings generally cannot withstand relatively harsh operating conditions.

Therefore, a need exists for a coating for harsh operating conditions, wherein confronting surfaces can maintain a sealed interface. The need further exists for a coating for confronting surfaces wherein the confronting surfaces may be subject to vibratory or oscillatory movement. A need also exists for a surface coating that can be used in a spherical slip joint, wherein the slip joint can maintain a sealed interface at elevated temperatures and pressure in a corrosive atmosphere. Further, a need exists for an as-sprayed coating which enables the coating to be cost-effective.

BRIEF SUMMARY OF THE INVENTION

Generally, the present method forms a surface coating to provide a sealed interface between confronting surfaces, such as spherical slip joints. The sealed interface is formed between surface coatings on the confronting surfaces. The surface coatings can be constructed to form the sealed interface without requiring post coating operations such as heating, polishing or finishing.

The method includes impacting the confronting surfaces with a metal powder and a non reactive grit mixture at a sufficiently high velocity and low temperature to form a metal layer on the confronting surface and substantially preclude a chemical reaction between the metal powder and the atmosphere, i.e. oxidation. The spraying parameters are selected to maximize deposit efficiency in the resulting surface coating with only trace amounts of the non-reactive grit. The coated confronting surfaces can provide a sealed interface when subject to vibratory movement as well as high temperature corrosion.

A spherical slip joint is provided, wherein confronting spherical male and female surfaces have a surface coating to form a sealed interface. The surface coating is at least 90% by weight metal and has a surface roughness less than 500 Ra microinches. In one configuration, the surface coating is at least 95% by weight metal and has a surface roughness less than 250 Ra microinches. In a further configuration, the surface coating is used without subsequent polishing, heating or treating processes. In a further configuration, it is contemplated the surface coating has a hardness and density greater than the metal powder applied without a non-reactive grit mixture or utilizing other conventional thermal technology. It is further contemplated that this mixture can only be effectively applied by an apparatus proving a temperature below a chemical reaction temperature with the non-reactive grit.

It is also contemplated that the grit can be non metallic and mixed with the metal powder. Alternatively, the metal powder can be applied at non reactive processing parameters, without incorporating the non reactive or non metallic grit.

BRIEF DESCRIPTION OF THE SEVERAL VIEWS OF THE DRAWINGS

FIG. 1 is a partial assembly view showing an operable environment of a spherical slip joint having a sealed interface between surface coatings.

FIG. 2 is a perspective view of the partial disassembly of the spherical slip joint of FIG. 1.

DETAILED DESCRIPTION OF THE INVENTION

Figure 3:
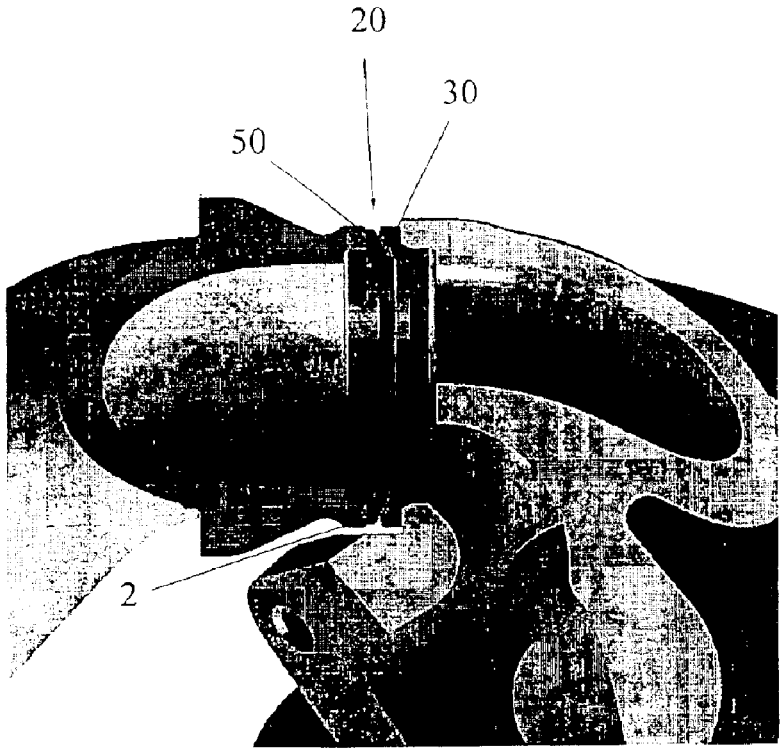
FIG. 3 is a cross sectional view showing a spherical slip joint having a surface coating.

Referring to FIG. 1, surface coating 2 is disposed on confronting surfaces in a spherical slip joint (20) to form a sealed interface. The spherical slip joint 20 includes a spherical seating surface 20 and a spherical mating surface 50 as seen in FIG. 3. The spherical slip joint allows relative motion of the confronting surfaces about three orthogonal axes. The sealed confronting interfaces are shown in a fluid transport system. For purposes of description, the fluid transport system is an exhaust gas recirculation system 10.

Generally, in an exhaust gas recirculation (EGR) 10, a fraction of the engine exhaust gases from the exhaust manifold 12 are recirculated to the intake manifold for purposes of engine emission control. During certain conditions of engine operation, an EGR valve 14 is opened and measured amounts of exhaust gas are routed to the intake manifold. The exhaust gas mixes with the incoming fresh air and displaces some of the oxygen therein. The reduced oxygen in the air results in a lower peak temperature in the cylinder during combustion, and the resulting levels of an $NO_x$ are also reduced. An advantage of the EGR is that engine timing can be optimized, which further enhances performance and fuel economy.

In implementation, the exhaust gas flows from the exhaust manifold 12 through an S-pipe 16 to the EGR valve 14 and then to a cooler. The interface between the S-pipe 16 and the exhaust manifold 12 and the S-pipe and the EGR valve 14 must be sealed. However, these interfaces are subject to relatively harsh operating conditions. For example, the temperature of the exhaust gas passing through the S pipe 16 are relatively hot and include corrosive components. In addition, the S-pipe 16 is subject to substantial vibratory (oscillatory) movement. This movement tends to substantially degrade any sacrificial seal material located at the interface. In addition, the gases within the S-pipe 16 may exert a relatively large pressure.

Typically, the exhaust gases traveling through the system have a temperature on the order of 1000° F. and include carbon monoxide, carbon dioxide, and corrosive gases as well as pressures resulting from a high performance turbo charger.

As seen in FIGS. 1 and 2, the S-pipe 16 is employed to interconnect the exhaust manifold 12 and the EGR valve 14 (or the cooler). As the S-pipe 16 is adjacent to and connected to the engine block, the interfaces between the S-pipe and the remaining portions of the system must accommodate individual vibration, thermal growth as well as assembly variations.

The S-pipe 16 is connected to the exhaust manifold 12 and the EGR valve 14 by spherical slip joints 20. In view of the anticipated range movement, the amount of rotation about each axis of rotation is limited. Thus, the spherical slip joint 20 is defined by a spherical seating surface 30 and a corresponding spherical mating surface 50. Although these surfaces are spherical, the surfaces can be formed on generally ring shaped substrates. The substrate can be integrally formed with the S-pipe, or can be a separately formed insert as shown in FIG. 3.

The seating and mating surfaces 30, 50 are formed on a substrate to which the surface coating 2 is applied. The substrate is preferably a metal, wherein stainless steel has been found an adequate substrate. The stainless steel can be 416. The seating and mating surfaces 30, 50 are configured to permit the relative movement between the surfaces. The surface coating 2 allows relative movement between the surfaces in the spherical slip joint 20 while maintaining a seal and minimizing wear there between.

The surface coating 2 is an agglomeration of partially melted metal particles, with trace amounts of non-reacted ceramic grit.

The surface coating 2 has an $R_A$ max of less than approximately 250 micro inches with less than 15% by weight non-reactive grit, with preferably less than 10% by weight non-reactive grit, and more preferred less than 5% by weight non-reactive grit.

The surface coating 2 is formed by impacting a mixture with the substrate of the confronting surfaces. The mixture includes particulate or powder metal constituents and a non reactive grit, such as a ceramic.

Preferably, the metal constituents of the mixture include boron, carbon, cobalt, chromium, copper, iron, manganese, molybdenum, nickel, silicon, and tungsten. A preferred combination of metals includes boron, carbon, cobalt, chromium, copper, iron, manganese, molybdenum, nickel, silicon, and tungsten. The combination of metals can have a density between approximately 8 g/cm$^3$ and 10.1 g/cm$^3$, with a preferred range between 8.6 g/cm$^3$ to 8.8 g/cm$^3$. The combination of metals can have a melting point between approximately 1200° C. to 1427° C., with a preferred melting point between approximately 1145° C. to 1427° C. A preferred composition of the metal constituents is marketed by Deloro Stellite Inc. of Belleville Canada as Stellite 6.

| Constituent | Available Range | Preferred Range | More Preferred Range |
|---|---|---|---|
| B | 0–1 | 0–1 | — |
| C | .1–3 | .5 .3 | 1.2 |
| Co | 30–65 | 40–65 | Balance |
| Cr | 8–34.5 | 23–34.5 | 29 |
| Cu | 0–2 | 0–2 | — |
| Fe | 0–24 | 0–3 | 2 |
| Mn | .1–1.5 | .5–1.5 | 1 |
| Mo | .1–30 | .1–1.5 | .6 |
| Ni | 0–24 | 0–7 | 2 |
| Si | 0–3 | 0–2 | 1.4 |
| V | 0–5 | — | — |
| W | 3–60 | 3–20 | 4.5 |

The metal constituents are typically in the form of a powder, with a particle size range of between 135 $\mu$m and 5 $\mu$m, with a preferred particle size range of 45 $\mu$m to 15 $\mu$m.

The non reactive grit can include ceramics, including but not limited to aluminum oxide ($Al_2O_3$), and silicon carbide. That is, the grit can be non metallic. A preferred non-reactive grit is aluminum oxide, having a particle size range of between 135 $\mu$m and 5 $\mu$m, with a preferred particle size range of 45 $\mu$m to 15 $\mu$m.

The mixture applied to the substrate (confronting surfaces) includes between approximately 70 to 90% by weight metal constituents and between approximately 10 to 30% non-reactive grit, with a preferred ratio of 75 to 85% metal constituents and between approximately 15 to 25% non reactive grit. Thus, the mixture that is sprayed on the substrate has a density of between approximately 7.7 to 7.9 g/cm$^3$.

The surface coating 2 has a thickness between approximately 200 microns to 350 microns, with a preferred thickness of between approximately 250 microns and 450, with a working thickness of about 275 microns. The surface coating has a density greater than the density of the impacted mixture. Typically, the density of the surface coating is greater than 8 g/cc. The microstructure of the surface coating 2 is a formation of partially melted metal particles, with aluminum oxide particles dispersed throughout the surface coating. The non reactive grit has not been subjected to sufficient heat or pressure to react with the metal constituents. Thus, there is no chemical reaction between the grit and the metal constituents. The surface coating 20 has a hardness of approximately 50 HRC. It has been found that when tested at 650° C. in an air environment for 180 hours, with 4 thermal shock tests (via water quench), produced minimal, if any observable microstructural effects. This result suggests the surface coating 2 provides adequate oxidation resistance.

The surface coating 2 has a bond strength greater than 10,000 psi.

The powder mixture is applied to the substrate at a sufficiently high velocity to form a surface coating 2 primarily composed of deformed metal particles, and a sufficiently low temperature to substantially preclude morphology change of the non reactive grit as well as preclude reaction of the grit and the metal constituents and atmospheric gasses.

Although the surface coating has been described as formed of a mixture of particulate or powder metal constituents and a non reactive or non metallic grit, such as a ceramic, it is understood the surface coating can be formed without the grit. That is, the surface coating is formed from the metal constituents as previously set forth, including but not limited to Stellite 6 as marketed by Deloro Stellite Inc. of Belleville Canada. The powder applied to form the surface coating can have density between approximately 8 to 10.1 g/cm$^3$, with a melting temperature of between approximately 1200–1427° C. and a particle size between approximately 15 $\mu$m to 135 $\mu$m.

An apparatus for impacting the powder mixture with the substrate is set forth and disclosed in U.S. Pat. No. 6,245,390 to Baranovski issuing Jun. 12, 2001, herein incorporated by reference.

Operation

Pursuant to U.S. Pat. No. 6,245,390, the above mixture is applied to the substrate of the confronting surfaces as a high velocity particle stream. The temperature of the particle stream is lower than a melting/fusing temperature of the non-reactive grit. That is, the temperature is sufficiently low to maintain the morphology of the non-reactive grit in a non-molten state.

The velocity of the particle stream is sufficient to deposit the metal powder on the substrate and form a metal layer bonded to the substrate, wherein the coating is substantially free of the non-reactive grit.

It is believed, the non-reactive grit may supply sufficient contact with the metal powder constituents to work harden the metal powder, as well as clean the spraying apparatus. In addition, it is believed the non-reactive grit assists in continually cleaning the surface of the substrate and initial coating layers of metal.

It has been found that a substrate impacted with the metal powder and the non-reactive grit produces a resulting coating having a hardness greater than a coating formed by the metal powder alone.

It is believed the $Al_2O_3$ provides a kinetic action temperature of up to 800 to 900° C. This heat contributes to the annealing of the metal constituents without resulting in chemical bonding to the non-reactive grit. In a preferred configuration, the coating is formed on mating spherical confronting surfaces, wherein the confronting surfaces form a sealed interface. Preferably, the sealed interface is free of a sacrificial surface or layer such as a gasket.

In those applications employing the non metallic grit, the processing parameters are selected to at least substantially preclude reaction of the grit, and reaction between the grit and the metal powder.

It is understood that alternative systems can be employed for impacting the powder mixture with the substrate. For example, an HVOF (Hyper Velocity Oxygen Fuel) system may be employed to provide the particle stream having the general parameters, as set forth for maintaining a temperature lower than a melting/fusing temperature of the non-reactive grit.

In addition, the surface coating allows the seating surface and the mating surface to be disposed in a sealed relationship, without requiring finishing, grinding or polishing of the surfaces prior to engagement. The surface coating 2 is functional without requiring heat modification of either the surface coating or the substrate. As no finishing operations are required for the surface coating, the cost of production is significantly reduced. That is, the surface coating 2 can be operably employed in an as formed, unfinished, state.

However, it is also understood, the surface coating 2 can be post treated to provide certain advantages. For example, it has been found in some applications, that a clamping force across surface coated confronting surfaces may sufficiently decrease during the operational life of the sealed interface, that the clamp must be tightened after a period of initial use. It is believed the surface coatings further seat against themselves. Thereby requiring additional clamping, while maintaining a sealed interface. Therefore, for some applications it has been found beneficial to grind, finish or polish the surface coating prior to contacting confronting surface coatings. In this configuration, the requisite clamping force is sufficiently constant throughout the operating life of the sealed interface, that readjustment of the clamping force is not required. The surface treatment provides a finder, smoother finish of the surface coating for making a precision fit, while retaining a sufficient layer to provide the material benefits of the coating. Though the post processing increases manufacturing costs, such increases may be offset by reducing maintenance of the clamping force.

For the surface coating formed from the metal constituents as previously set forth, including but not limited to Stellite 6, without the non reactive grit, the processing parameters of the metal constituents are maintained to at least substantially preclude reactions of the constituents. That is, the metal constituents are applied in a non reactive process, while still forming the lenticular surface coating. The metal constituents, when applied without the grit are partially melted, or deformed to form the surface coating 2.

While the invention has been described in connection with a presently preferred embodiment thereof, those skilled in the art will recognize that many modifications and changes made be made therein without departing from the true spirit and scope of the invention, which accordingly is intended to be defined solely by the appended claims.

What is claimed is:

1. A method of forming a surface coating on confronting spherical surfaces, the surfaces defining a sealed interface there between, the method comprising:

(a) impacting each of the confronting spherical surfaces with a mixture of a given density on the confronting surfaces, the mixture comprising chromium, cobalt, iron, and silicon, and a ceramic/non-reactive grit, to form a surface coating, the surface coating having a density greater than the given density; and (b) engaging the confronting surfaces to form a sealed interface there between.

2. The method of claim 1, further comprising impacting each of the confronting spherical surfaces with aluminum oxide as the ceramic grit.

3. The method of claim 1, further comprising impacting each of the confronting spherical surfaces with a mixture having less than 5% by weight non-reactive grit.

4. The method of claim 1, further comprising impacting each of the confronting spherical surfaces with a mixture at a temperature less than a melting point of the non-reactive grit and at a velocity sufficient to bond at least a portion of the chromium, cobalt, iron, and silicon to the substrate.

5. A method of forming a sealed interface between two confronting surfaces, the method comprising:

(a) impacting each of the confronting surfaces with a mixture of metal powder and a non reactive grit to form a surface coating, the mixture having a given hardness and the surface coating having a hardness greater than the given hardness; and (b) contacting the surface coatings to form a sealed interface.

6. The method of claim 5, further comprising forming the mixture with between 70% to 90% by weight metal powder and between 30% to 10% by weight non reactive grit.

7. The method of claim 5, further comprising forming the mixture with the metal powder having a particle size between 5 $\mu$m and 135 $\mu$m.

8. The method of claim 5, further comprising forming the mixture with the non reactive grit having a particle size between 5 $\mu$m and 135 $\mu$m.

9. A method of forming a sealed interface between confronting surfaces, (a) forming a coating having a density greater than 8 g/cc and an $R_A$ between 50 microinches and 250 microinches on each of the confronting surfaces, from impacting a mixture having a density less than 8 g/cc; and (b) maintaining the surfaces in a sufficient contacting relationship to form a sealed interface between the coated confronting surfaces.

10. The method of claim 9, further comprising contacting the coated surfaces prior to surface treating the coated surfaces.

* * * * *